US005734392A

United States Patent [19]

Cornell

[11] Patent Number: 5,734,392

[45] Date of Patent: Mar. 31, 1998

[54] INK JET PRINTHEAD HEATING DURING MARGIN PERIODS

[75] Inventor: Robert Wilson Cornell, Lexington, Ky.

[73] Assignee: Lexmark International, Inc., Lexington, Ky.

[21] Appl. No.: 528,487

[22] Filed: Sep. 14, 1995

[51] Int. Cl.[6] ..... B41J 29/38; B41J 2/05

[52] U.S. Cl. ..... 347/17; 347/60; 347/186

[58] Field of Search ..... 347/17, 67, 18, 347/14, 60, 186

[56] References Cited

U.S. PATENT DOCUMENTS 5,168,284 12/1992 Yeung ..... 346/1.1

5,175,565 12/1992 Ishinaga et al. ..... 347/17

5,559,535 9/1996 Otsuka et al. ..... 347/14

*Primary Examiner*—Mark J. Reinhart

*Assistant Examiner*—Thien Tran

*Attorney, Agent, or Firm*—John A. Brady

[57] ABSTRACT

The heater chip (1) of an ink jet printer (10) has two substrate-heater resistors (3*a* and 3*b*) powered by the same power supply (24) as are the nozzle heaters (5) on the chip. Printhead (12) carries chip (1) and moves across paper (16) alternately left-to-right followed by right-to-left. Operation is during the margin periods when the nozzle heaters are not in operation. The power supply is thereby efficiently utilized.

4 Claims, 2 Drawing Sheets

INK JET PRINTHEAD HEATING DURING MARGIN PERIODS

TECHNICAL FIELD

This invention relates to the field of thermal ink jet printing, and, more specifically, to heating a thermal printhead to maintain desirable operating temperatures.

BACKGROUND OF THE INVENTION

Thermal ink jet printers produce images on paper by shooting precisely sized droplets at precisely defined positions. Image quality is a function of the printed spot size. Since the size of the spots on the page are a strong function of the drop mass of the individual droplets, precise control over drop mass is an important factor.

The mass of the ejected droplet is a strong function of temperature. Temperature controls the thermal energy in the ink and the size of the vapor bubble that drives the ink from the firing chamber. Similarly, temperature affects the viscosity of the ink and this in turn also affects drop mass because of viscous losses in the firing chamber. It is common in the industry, appearing in a number of patents, to attempt in some way to control the temperature of a thermal printhead for the purpose of controlling drop mass and thereby to control spot size and image quality. U.S. Pat. No. 5,168,284 to Yeung is representative. It employs the thermal drop-forming system to also heat the printhead when not being used to form drops.

Known in various forms in the prior art is the reducing of energy pulses applied to the drop-creation heaters. These are the heaters physically proximate to printhead nozzles which vaporize the ink at each nozzle to create the ink drop from each nozzle. The reduced energy pulses do not contain enough energy to cause bubble nucleation and growth, so no ink is expelled. But they do increase the temperature of the printhead by adding heat energy from the drop-creation heaters.

The chip temperature is monitored by some means, usually a diode or a serpentine shaped aluminum resistor integrated into the heater chip. When the chip temperature is below a certain threshold, the nonjetting pulses are sent to the active heaters to warm the chip.

This technique has advantages and disadvantages. One advantage is that substrate heating can be accomplished with the same voltage source as required for jetting by simply reducing the pulse width of the nonjetting pulses. The other advantage is that no increase in silicon area ("real estate") is required to accomplish substrate heating since the substrate heaters and the active heaters are the same. A disadvantage of using the active heaters to maintain the chip temperature is the added workload to an already highly stressed, highly cycled component of the printer. This increases the probability of failure.

A second prior art approach uses separate substrate heaters. These are large area devices that are connected to a separate power source. Because silicon has a very high thermal conductivity, these heaters are just as effective in maintaining constant chip temperature as the foregoing approach. The advantage of separate substrate heaters is the ease by which heating can be accomplished without interfering with the data stream that is to be printed. The other advantage is the reduced workload on the active heaters. Separate substrate heaters appear to be the preferred choice in permanent and semi-permanent printheads. These known printheads, however, have the disadvantage of employing a separate power source to provide the voltage to drive the separate heaters. In an actual printer sold as the Canon BJC600 printer, the drop forming heaters have a 19 volt source and the separate substrate heaters have a 27 volt source. Since power supplies for thermal ink jet must be high current, high precision components, generally of 2% or less variation in output voltage, employing two precision supplies increases the cost of the printer significantly.

DISCLOSURE OF THE INVENTION

In accordance with this invention the printhead of an thermal ink jet printer is designed to incorporate separate substrate heaters. The separate heaters are driven just during margin operations of the printer. The margin operation is considered the time between the end of one line printed and the beginning of the printing of the next line. Since this involves at least a reversal of movement of the printhead, significant time is available during margin operations. During margin operations the power .supply for the drop-creating heaters is idle. In accordance with this invention the substrate heaters are heated from that power supply.

That power supply, for quality drop production, necessarily is a precision power supply capable of supplying high current. Instead of it being idle, in accordance with this invention it is used to drive the substrate heaters. The power the substrate heaters consume is less than the power the drop-creating heaters consume during printing, so no increase in the power supply capability is required.

BRIEF DESCRIPTION OF THE DRAWING

The details of this invention will be described in connection with the accompanying drawing, in which.

BEST MODE FOR CARRYING OUT THE INVENTION

Figure 1A:
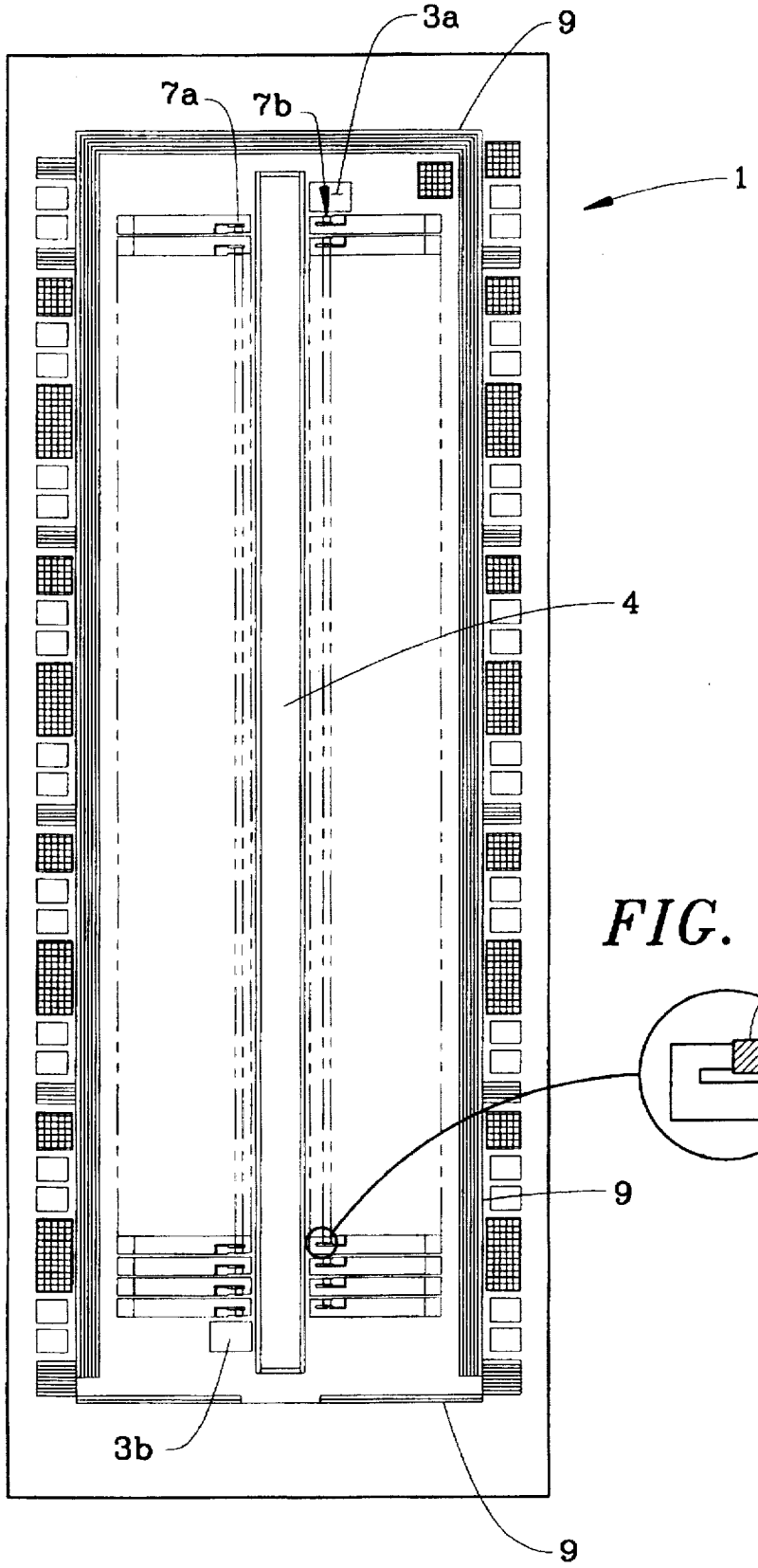
FIG. 1*a* is illustrative of a silicon wafer or chip containing the drop-creating resistors, and the substrate-heating resistors, as well as associated elements and a central ink channel.
Figure 1B:
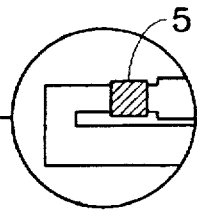
FIG. 1*b* is an enlargement of a portion of FIG. 1*a* having a drop-creating resistor.

FIG. 1*a* shows a silicon chip 1 which is essentially standard for this technology, having embedded resistors 3*a* and 3*b* positioned on the top and bottom. Chip 1 is populated with control leads and drive FET transistors as is standard and therefore not shown in any detail. All elements of chip 1 are formed by ion implant or other standard techniques of semiconductor circuit fabrication. Also found on chip 1 are a long, central hole or channel 4 to transmit ink, drop-creating resistors 5 see FIG. 1*b* positioned in two columns 7*a* and 7*b*. As is standard, a member having nozzle holes will be placed so that each resistor 5 is proximate to one nozzle hole, so that powering of a resistor 5 vaporizes part of liquid ink under the nozzle and expels a drop of ink.

Also embedded in chip 1 is a encircling resistor 9 of resistivity heat-responsive material, such as aluminum, which is located around the chip periphery so as to be proximate to much of the chip as a whole. That resistor is employed as a temperature sensor by measuring current through the resistor at controlled voltages.

Figure 2A:
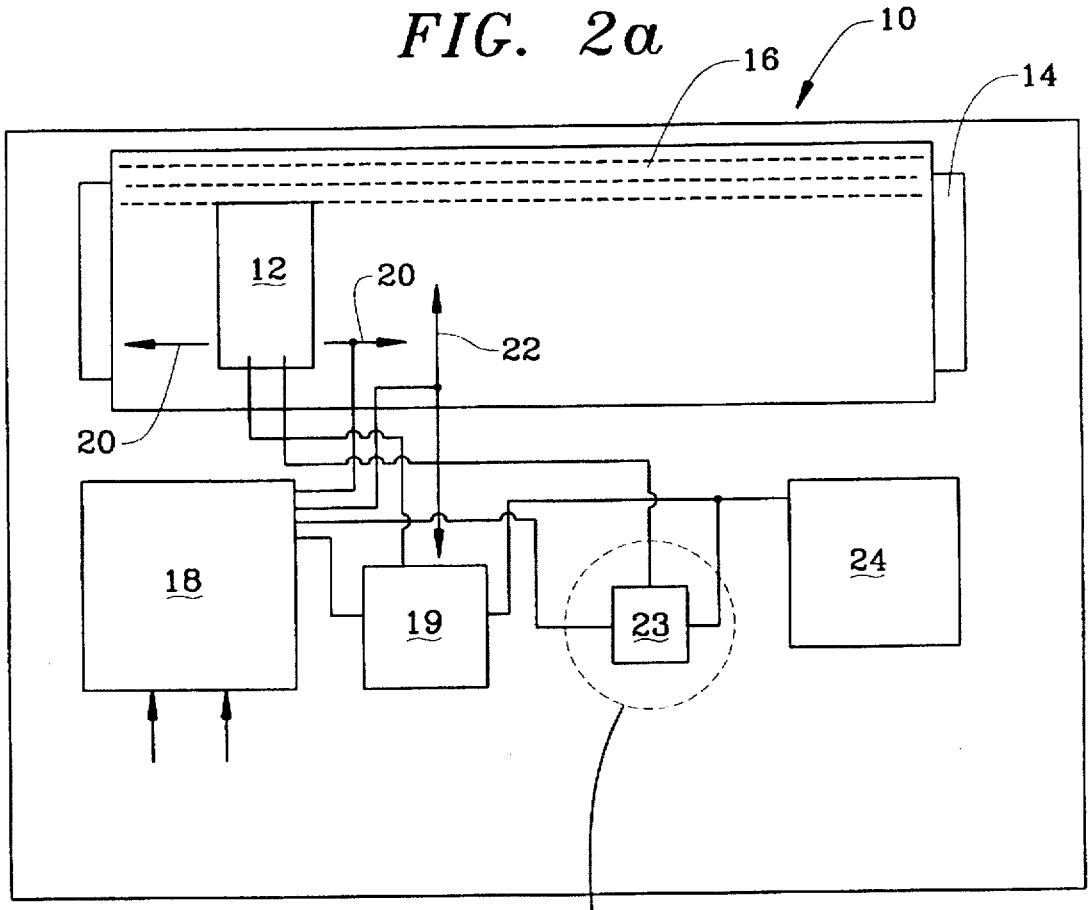
FIG. 2*a* is illustrative of the printer as a whole containing the chip of FIG. 1*a*.

FIG. 2*a* is illustrative of the printer 10 and its operating system with respect to employing a printhead 12 having a chip for nozzle heating as described with respect to FIG. 1*a*. Printhead 12 is mounted above to a paper support 14 to move laterally across the support 14 on which paper 16 or other final substrate is mounted. Printing is by ink dots expelled downward by printhead 12.

Operation of printer 10 is controlled by a microprocessor or other electronic controller 18 as is standard. Page information is received by controller 18 and controller 18 defines the operations of printhead 12 through print head driver circuits 19 as well as printhead transport 20 (shown illustratively as arrows) to move the printer across the paper 16 and paper transport 22 (shown illustratively) to move the paper in accordance with the page information. Such operation may be entirely standard and therefore will not be discussed in detail.

Figure 2B:
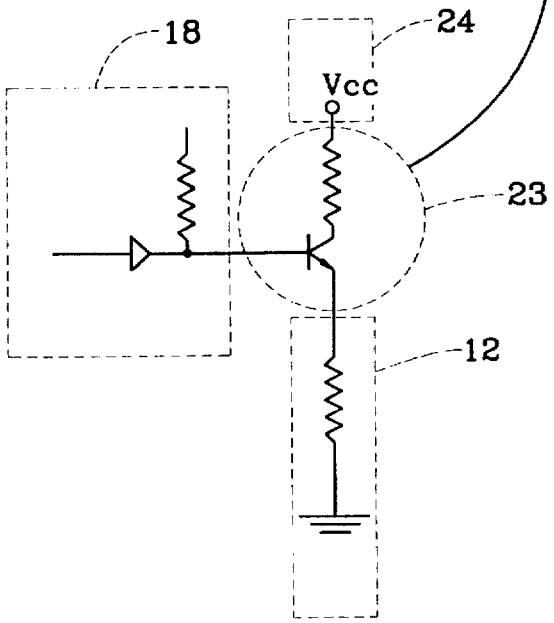
FIG. 2*b* shows details of a part of FIG. 2*a*.

Controller 18 necessarily produces a unique logic condition when either transport 20 or transport 22 is to be activated and also necessarily produces a different unique logic condition when printing on a line is to commence. In accordance with this invention controller 18 also produces a control output to substrate heater driver circuit 23 responsive to the unique transport signal for 20 which causes current drive from power supply 24 to substrate resistors 3*a* and 3*b*. The period of that drive is determined by controller 18 as a function of the resistivity of serpentine resistor 9. FIG. 2*b* illustrates a representative substrate heater driver circuit as connected to elements of FIG. 2*a*. The same voltage which powers substrate driver 23 powers print head driver 19.

The period between the unique transport signal and the signal to commence printing is termed the period of margin activity. Resistors 3*a* and 3*b* do not require power during all of each period of margin activity. Power supply 24 also supplies power to nozzle resistors 5. Resistors 3*a* and 3*b* are sized to employ the same potential as resistors 5, so power supply 24 has no special design element related to driving resistors 3*a* and 3*b*.

Printer 10 is generally similar to the ExecJet IIc printer sold by the assignee of this invention. That printer prints alternately from left-to-right and followed by right-to-left and continuing in such sequence. The actual printing of a line takes about 250 ms. The margin period is about 800 ms. That time is sufficient to reverse the momentum of the printhead and is more than adequate time to raise the chip temperature by 40 degrees C.

The chip 1 does not need to be held at some elevated temperature in the standby mode (when it is not actively printing or preparing to print). It can be heated to the printing temperature in a time that is imperceptible from a normal turnaround of transport 20 (carrier turnaround). Additionally, the substrate heaters 3*a* and 3*b* can be sized to cover a minimal amount of silicon real estate. Specifically in the embodiment they are 412 microns long by 242.5 microns wide. They are connected in parallel, and each resistor 3*a* and 3*b* draws 3 watts of power and 250 milliamperes of current. They heat the chip 1 from 20 degrees C. to 60 degrees C. in less than 1 second. The balanced location of resistors 3*a* and 3*b* on opposite sides of chip 1 provides even heating as the thermal conductivity of silicon, the major component of chip 1, is high.

Variations in the design and layout of the printhead and of the period and sequence of operation during the margin period can be anticipated.

What is claimed is:

1. A thermal ink jet printer which prints lines of dots by movement of a printhead with a period of time for reversal of said movement between said printing of lines of dots, said printhead comprising a semiconductor chip having dot-creating resistors for creating heat to vaporize liquid to create said ink dots which are expelled through a nozzle proximate to each said dot-creating resistor, said printer comprising at least one additional, substrate-heating resistor in said chip to heat said printhead, a power supply connected to drive said dot-creating resistors and said at least one substrate-heating resistor, electronic control apparatus to recognize said period between said printing of lines of dots by said printer and to create a control condition in which said at least one substrate-heating resistor is powered from said power supply only during said period between the printing of lines.

2. The ink jet printer as in claim 1 in which said at least one substrate-heating resistor comprises two resistors on opposite sides of said chip.

3. The ink jet printer as in claim 2 in which the printhead of said printer is not heated during standby condition when said printhead is not activated for said movement.

4. The ink jet printer as in claim 1 in which the printhead of said printer is not heated during standby condition when said printhead is not activated for said movement.

* * * * *